US006004113A

United States Patent [19]

Vay

[11] Patent Number: 6,004,113

[45] Date of Patent: Dec. 21, 1999

[54] SUSPENSION FOR HERMETIC COMPRESSORS FOR REFRIGERATION

[75] Inventor: Martin Vay, Campinas, Brazil

[73] Assignee: Barnes Group, Inc., Bristol, Conn.

[21] Appl. No.: 09/320,475

[22] Filed: May 26, 1999

[30] Foreign Application Priority Data

Jun. 5, 1998 [BR] Brazil ..... 9802262

[51] Int. Cl.[6] ..... F04B 35/04

[52] U.S. Cl. ..... 417/363; 248/624

[58] Field of Search ..... 417/363, 902; 248/618, 624, 622, 638

[56] References Cited

U.S. PATENT DOCUMENTS

| | | | |
|---|---|---|---|
| 1,848,514 | 3/1932 | Cunninghah | 248/624 |
| 2,222,724 | 11/1940 | Rogers | 248/624 |
| 2,349,845 | 5/1944 | Cody | 417/363 |
| 3,540,813 | 11/1970 | Murphy | 417/363 |
| 3,887,303 | 6/1975 | Matsuzaka et al. | 417/363 |
| 4,511,314 | 4/1985 | Fraser, Jr. et al. | 417/363 |
| 4,549,859 | 10/1985 | Andrione et al. | 417/363 |
| 5,342,179 | 8/1994 | Dreiman | 417/363 |

*Primary Examiner*—Charles G. Freay
*Assistant Examiner*—Robert Z. Evora
*Attorney, Agent, or Firm*—Vickers, Daniels & Young

[57] ABSTRACT

Improvement of the suspension of hermetic compressors for refrigeration in the interior of a hermetically closed shell (A) through a suspension (S) formed by a set of helicoidal springs (1), which extremities have upper (2) and lower (3) means of support and fitting to the corresponding parts of the compressor (C) and the shell (A); said upper and lower means of fixation of each spring (1) presents a truncated conical tip (4) for penetrating the internal diameter of the spring, while on the opposite end, it includes a flange (5) for seat, foreseeing inclusively an upper perforation (6) for the penetration of a pin (P) existent on the corresponding part of the compressor (C) so that the compressor (C) can be fixed in a springy way to the interior of the shell (A), using seating surfaces (7A), helicoidal or spiraled, practically the shape of one coil, where a step (8) that confers fitting and, at the same time, encloses the uneven circular surface that compensates the unevenness resulting from the tip (9) of the spring (1), so that this last one can have a horizontal support cooperating to keep it squareness.

8 Claims, 12 Drawing Sheets

SUSPENSION FOR HERMETIC COMPRESSORS FOR REFRIGERATION

This invention refers to technical and functional improvements specially developed having in mind the characterization of specific improvement of the mounting and functioning of the elastic suspension of hermetic compressors used in refrigerating systems. Such improvements include modifications made to the spring seats that form the supporting elastic suspension usually used as suspension of the compressors' whole internal set of components (rotor, stator, muffler, etc.). The proposed improvements were created having as a main objective to simplify the manufacture of the spring and consequently to reduce the final cost of the whole.

Such compressors are utilized in domestic or industrial refrigerating systems, particularly in products generically known as: refrigerator, freezer, air conditioning, drinking water fountain, water filters and/or other similar products.

BACKGROUND OF THE INVENTION

Most compressors used in refrigerating systems are of the hermetic type and this fact alone already characterizes a practically "non disassembling" whole for eventual maintenance and in case of defect the whole unit is replaced. Consequently, the compressor is the most important part of a refrigerating system which added to the fact that the same is hermetic, it demands rigorous manufacturing criteria. That is to say, it is very important to have an excellent quality level in its manufacturing such that it can function properly for substantially long periods. Otherwise any defect will require replacement of the whole compressor.

The compressor is one of the most important parts of a refrigerating system. This is not only because it is a complete machine but also because it is hermetically closed and therefore is usually formed by several components including its shell (base and hood) that constitutes a true hermetic wrapping along with the internally mounted components that form the compressor itself. The internally mounted components are kept suspended in the shell's interior through a set of compression springs or extension springs. In both cases, such springs are of the helicoidal type, having lower extremities leaned on proper places existing in the internal part of the shell (base), while the upper extremities find strategically placed fixation points distributed along the compressors' mechanism. Thus, except for the shell, all the internal parts of the compressor itself are kept suspended by a whole, here defined as "elastic suspension", that has two different functions. The first is to fix the whole to the interior of the shell. The second is to impede mechanical vibrations of the pump or the compressor proper from being transmitted to the shell and to the final product (refrigerator, freezer, air conditioning, water fountain or filter), thus causing an unwanted level of noise.

FIGS. 1 and 2A–2B show a conventional compressor generically constituted by a shell (A), hermetically closed, with feet (B), as well as the compressor (C) mounted in the interior which is itself formed by several components (stator, rotor, muffler, etc.), defining a unitary whole, totally mounted or fixed to the shell's (A) interior through a suspension formed by a set of helicoidal springs (1), whose extremities find upper and lower means of support and fitting existing on corresponding parts of the compressor (C) and the shell (A), in such a way that the compressor can operate while suspended, having as support the springed set.

At present all the compressor springs (1) are necessarily finished at their extremities, going through a grinding operation (R) and consequently, both spring extremities become parallel to themselves and guarantee a perfectly horizontal and perpendicular mounting, that is to say, with the ground extremities, each spring is vertically adjusted to its position of use so that there is a perfect seating of the whole compressor on the springs set. This is because if the springs were not ground in (R), the wire on the last coil would be round, configuring a kind of a step, causing the inclination of the spring, which would not be appropriate for the mounting of the whole. However, such problem is completely eliminated with the grinding operation (R) on the spring's extremities and with that the last coil is reduced, losing gradually its diameter thickness and in this way it just fills the part corresponding to the spring's extremity so as to stay vertically aligned with its vertical axis. The above technique managed to produce an adequate spring for the compressor's elastic support. However, the grinding operation applied to both extremities of each spring slows the production process, and increases considerably the final cost of the whole.

SUMMARY OF THE INVENTION

The present invention is an improvement of the suspension for hermetic compressors for refrigeration. Whereas the foreseen modifications were all concentrated only on the leaning points of the upper and lower extremities of the springs, foreseeing seats with configurations specially created so as to compensate the unevenness of its extremities, in the present invention, the spring is not put through a grinding operation (R), thus keeping its wire's section uniform. The stairs formed at its extremities are compensated with a seat with equal steps thus providing a perfect match between the extremities of the spring and its respective seat.

In such condition, the first advantage of the whole in question is the elimination of a special grinding operation to substantially simplify the spring's manufacturing process and in turn reduce its final cost.

BRIEF DESCRIPTION OF THE DRAWINGS

For the better understanding of the present invention, there follows a detailed description of it, containing references to the drawings attached, where.

DETAILED DESCRIPTION OF THE INVENTION

Figure 1:
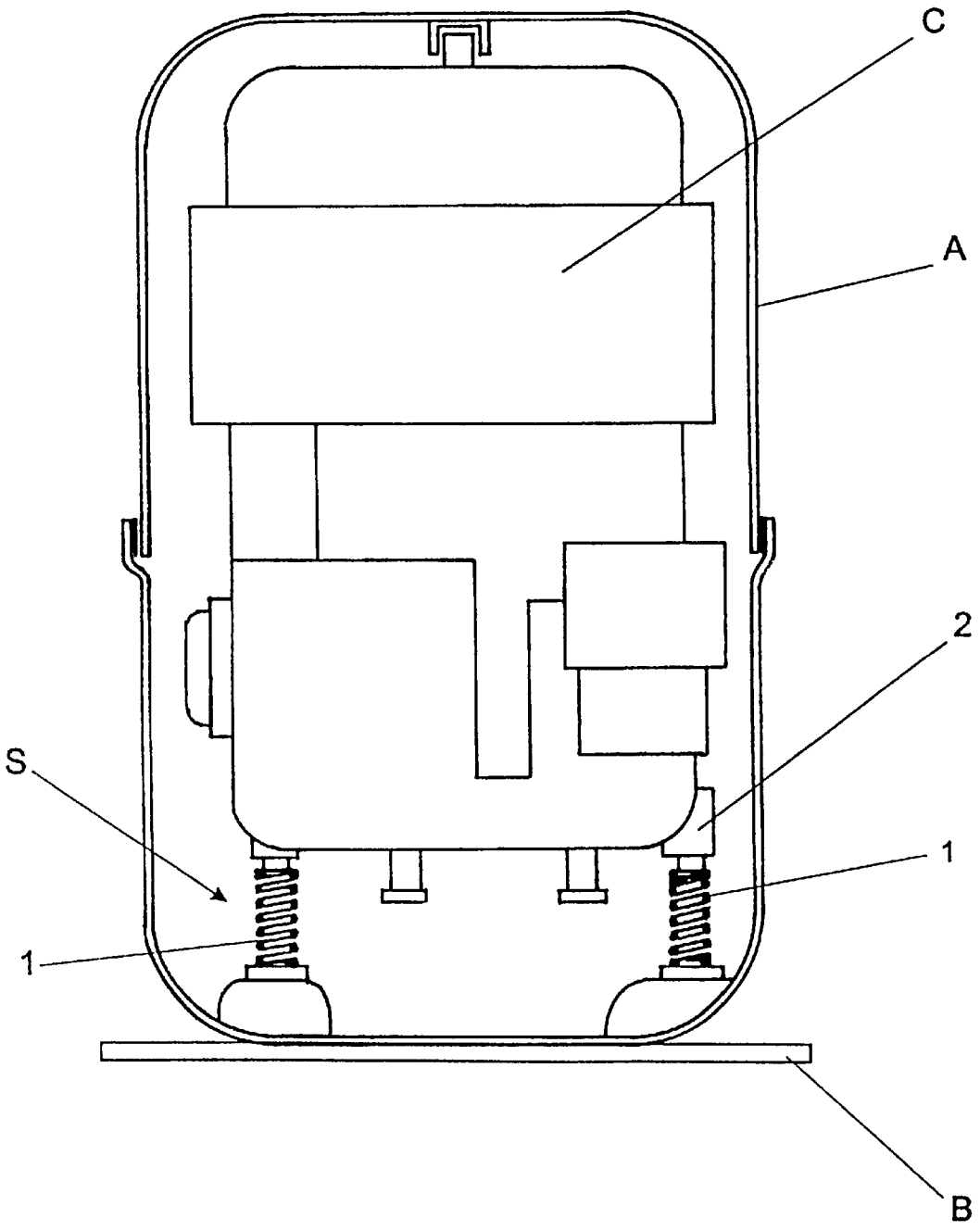
FIG. 1 PRIOR ART
FIG. 1 represents a lateral cut view, showing schematically a usual compressor, highlighting the elastic suspension as a whole.
Figure 2A:
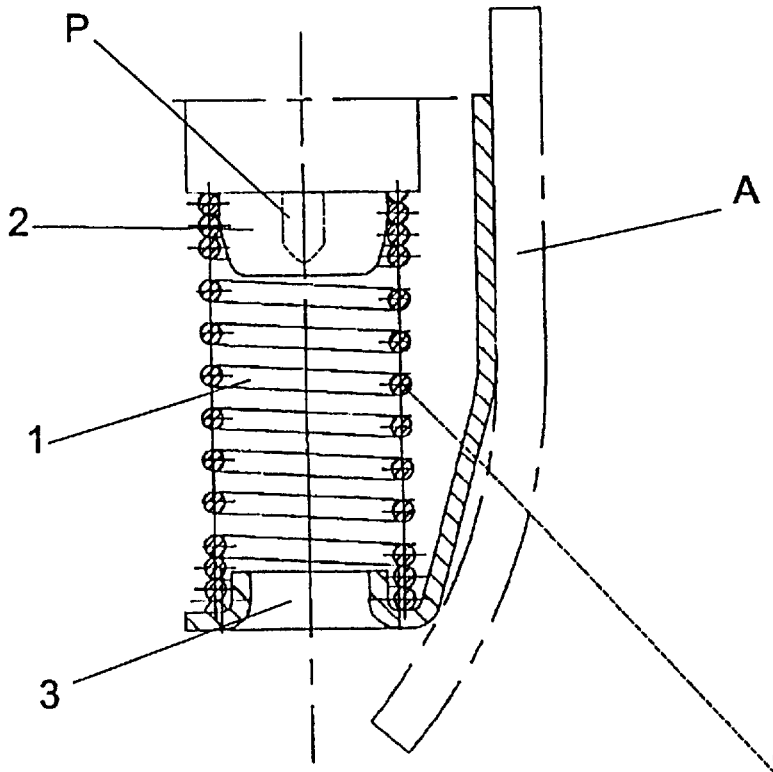
FIG.2A PRIOR ART
FIGS. 2A–2B shows a lateral cut view of an enlarged detail highlighting one of the springs of the elastic suspension.
Figure 2B:
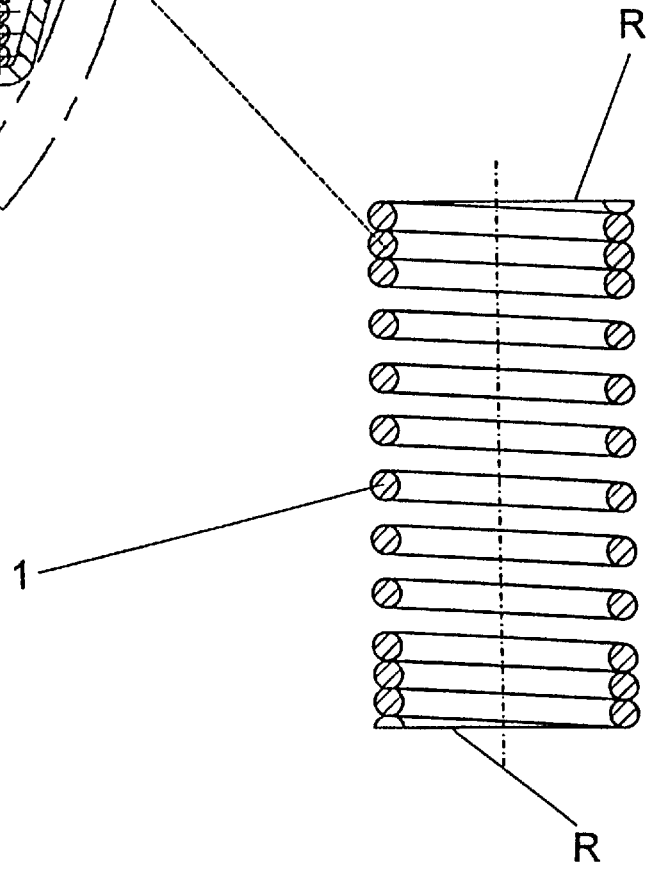

According to these illustrations and to its details, particularly FIGS. 1 and 2A–2B, the present improvement of the suspension for hermetic compressors for refrigeration, is the type passive of being adopted for the production of innumerous kinds of hermetic compressors, domestic or industrial, used in different types of products such as refrigerators, freezers, air conditioning devices, water fountains, water filters and/or other similar as in all these cases, said compressor is generically constituted by a shell (A) hermetically closed, with feet (3) as also in its interior is mounted the compressor itself (C), formed by various components (rotor, stator, muffler, etc.), defining a sole set, totally mounted or fixed to the shell's interior through a suspension (S), formed by a set of helicoidal springs (1) which extremities have upper (2) and lower (3) means of support and fitting on those parts corresponding to the compressor (C) and to the shell (A).

Figure 3:
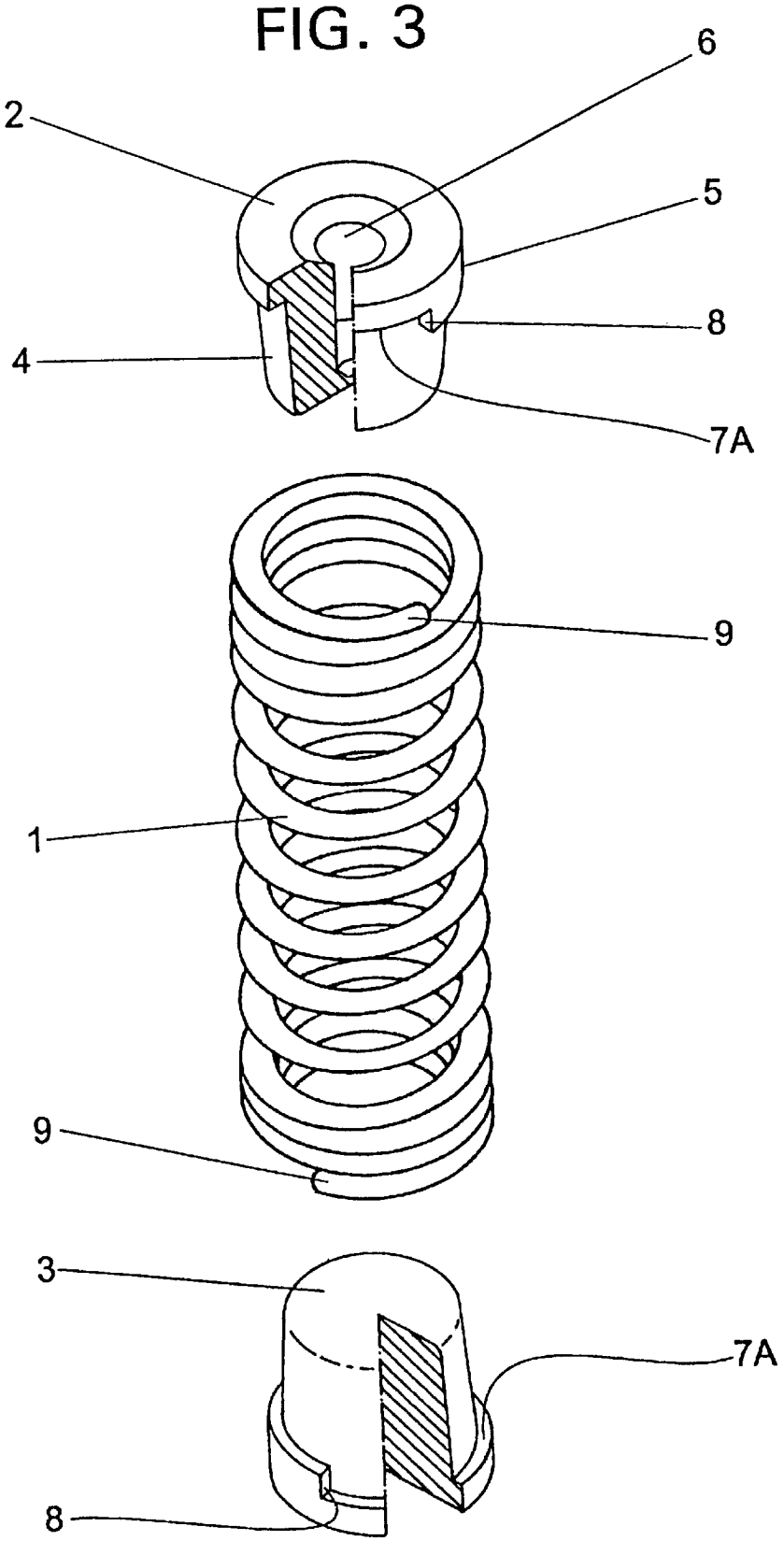
FIG. 3 illustrates a blown up perspective view highlighting the first constructive version of the invention—helicoidal seat in a solid block for a spring without grinding.
Figure 4:
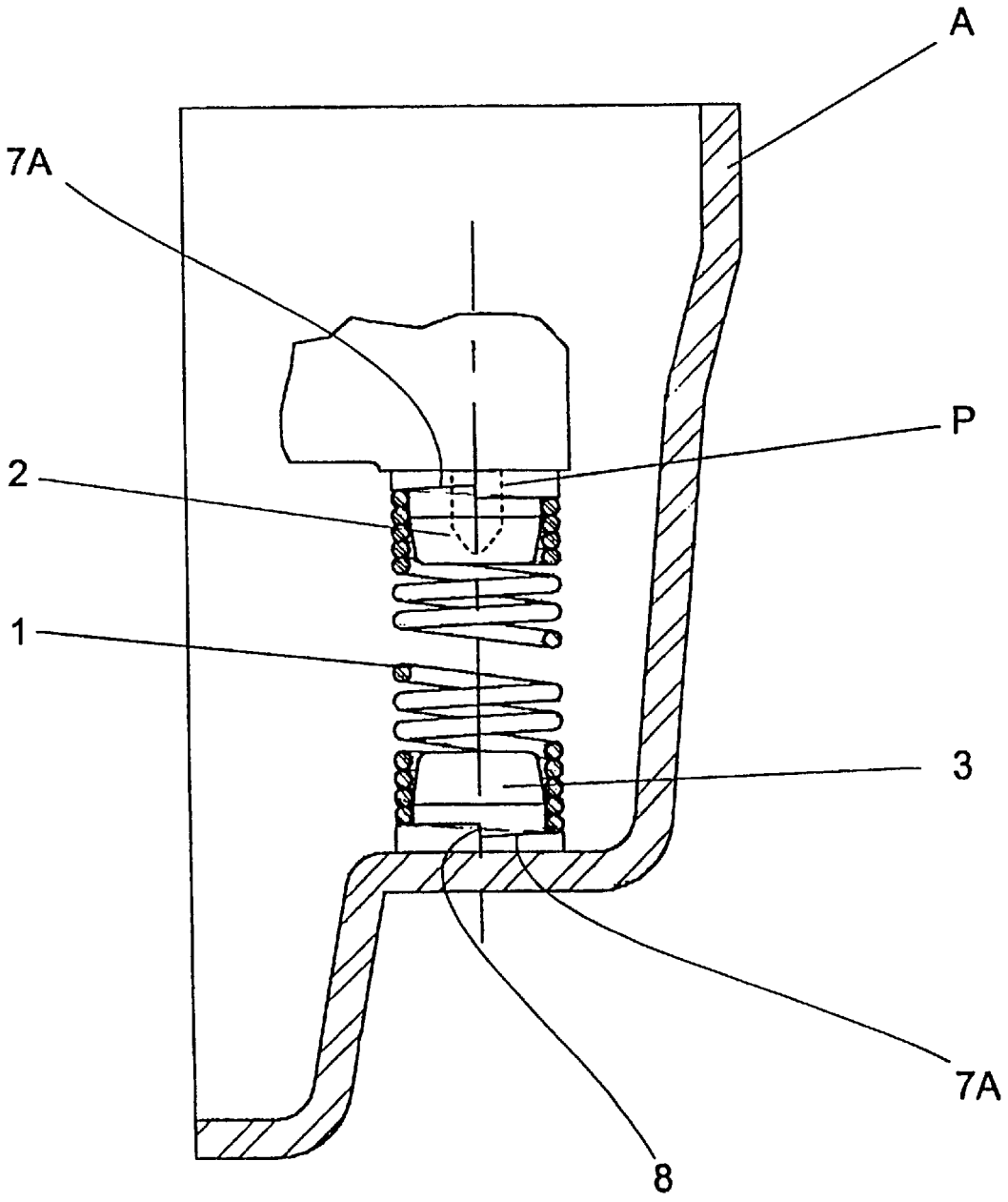
FIG. 4 shows a lateral cut view of the first constructive mounted version.

Relating to FIGS. 3 and 4, each spring's upper and lower means of fixating (1) can vary in its form and material, nevertheless, generally it is foreseen a cylindrical part that on one side presents a truncated conic end (4) for penetrating the spring's inner diameter while on the opposite side, includes a seating flange (5), being foreseen also an upper hole (6) for the penetration of a pin (P) that exists on the corresponding part of the compressor (C). This same situation could occur or not at the lower end, however, these details can vary radically without changing or not the spring's support and pre mounting concept, so that the compressor (C) may be fixed in a springy way at the interior of the shell (A).

In a first constructive version illustrated in FIGS. 3 and 4, the present invention is characterized by the fact that the face turned toward the inner part of the flange (5), as much for the upper part (2) as for the lower one (3), presents a helicoidal seating surface (7A) practically in the form of a spring coil, where a step (8) confers fitting and at the same time encloses an unleveled circular surface compensating the springs (1) unleveled end (9) in such a way that this last one can have a horizontal support that cooperates to keeping its squareness.

Figure 5:
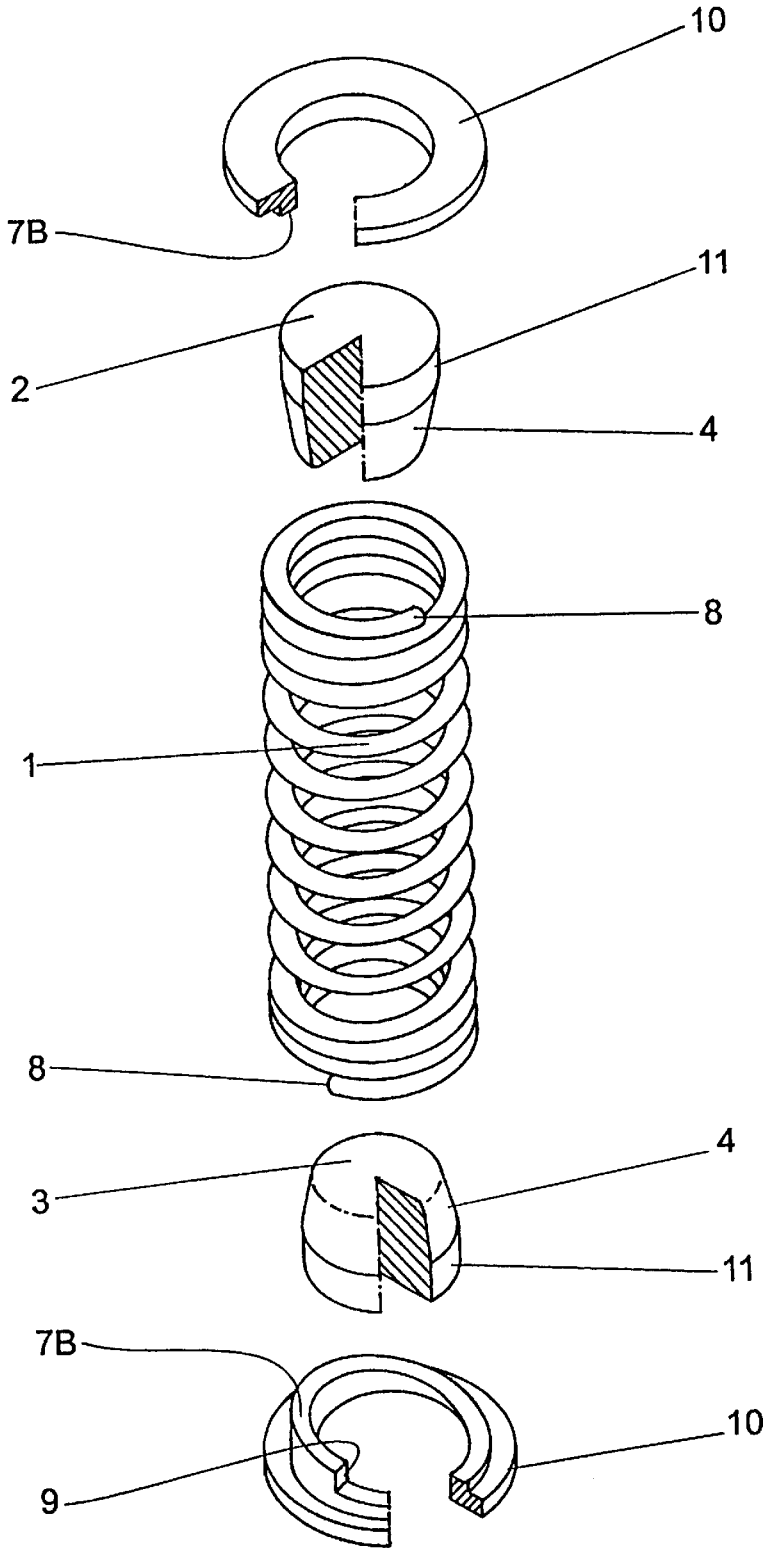
FIG. 5 illustrates a blown up perspective view highlighting the second constructive version of the invention—helicoidal seat configured at one of the sides of a ring, forged for a spring without grinding.
Figure 6:
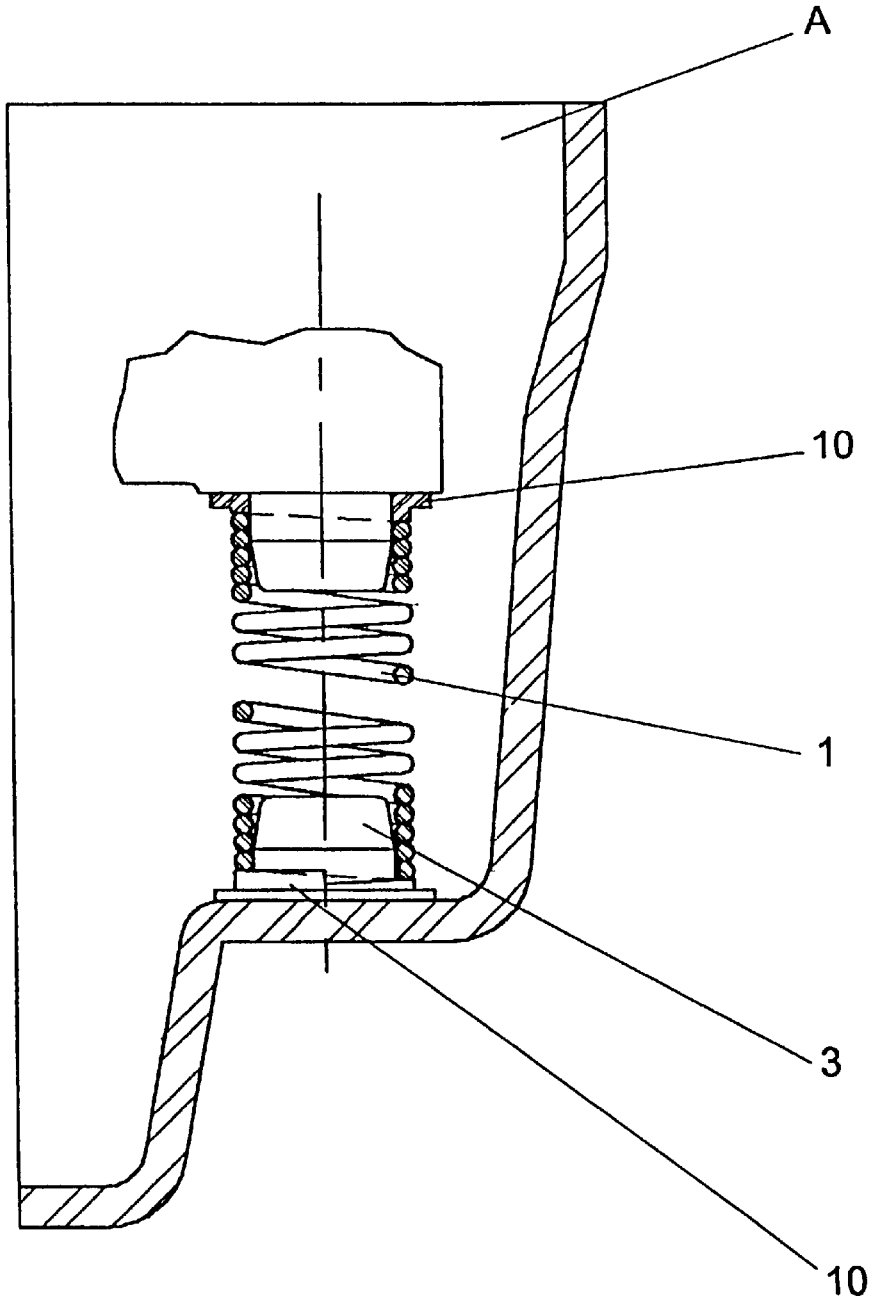
FIG. 6 represents a lateral cut view of the second constructive version mounted.

Relating to FIGS. 5 and 6 in a second constructive version, the invention characterizes itself by the fact that the helicoidal seats (7B) are projecting and integrated to the faces turned to the inner side of the rings, preferably cold forged (10), in which inner diameters are fit the cylindrical bases (11) of parts (2) and (3), which conical parts (4) penetrate in the corresponding extremities' inner diameters of the spring (1), where the tips (8) of its wire are fit into the steps (9) of the seats (7B).

Figure 7:
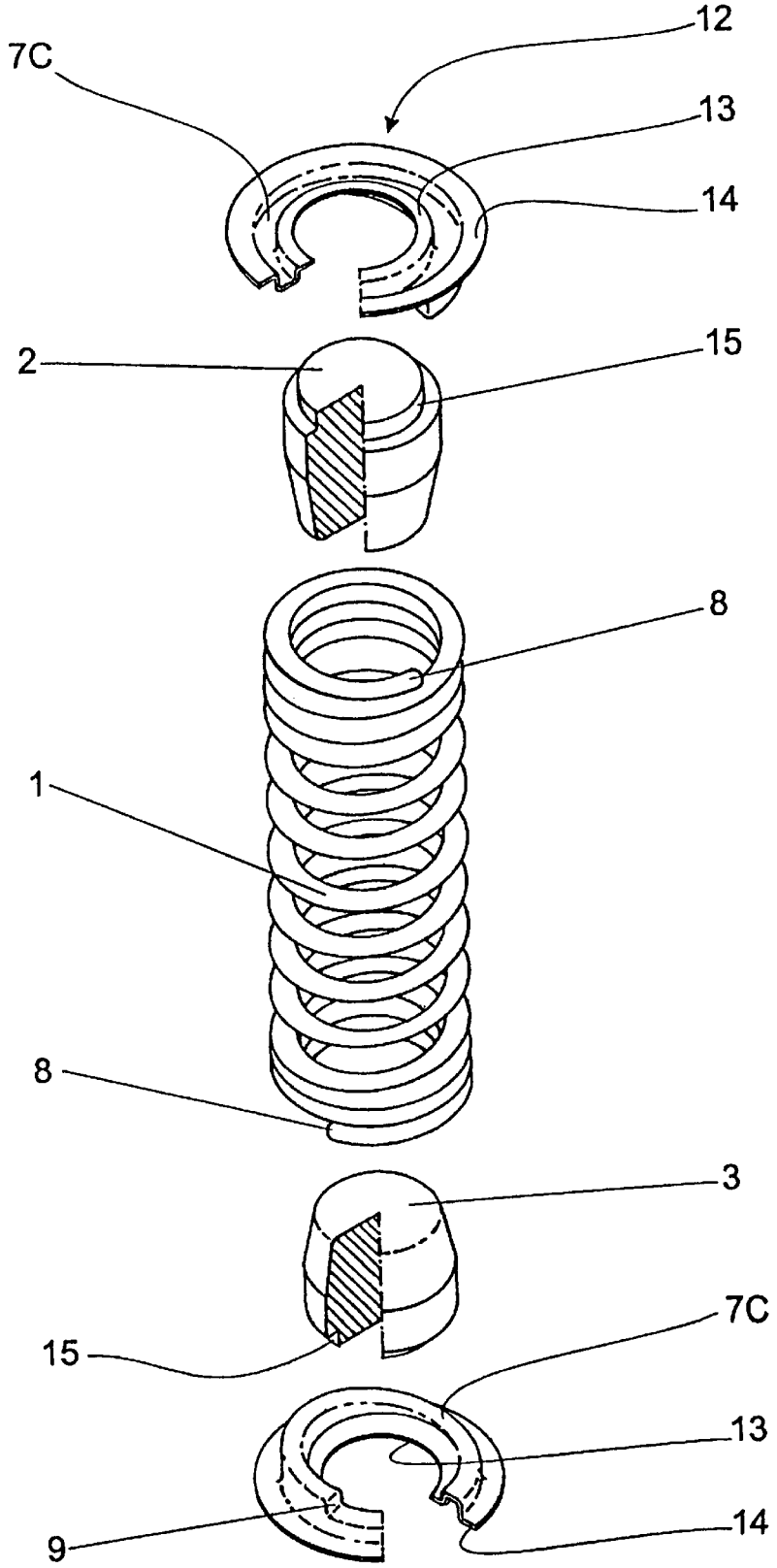
FIG. 7 shows a blown up perspective view highlighting the third constructive version of the invention—helicoidal seat stamped out of a metal sheet for spring without grinding.
Figure 8:
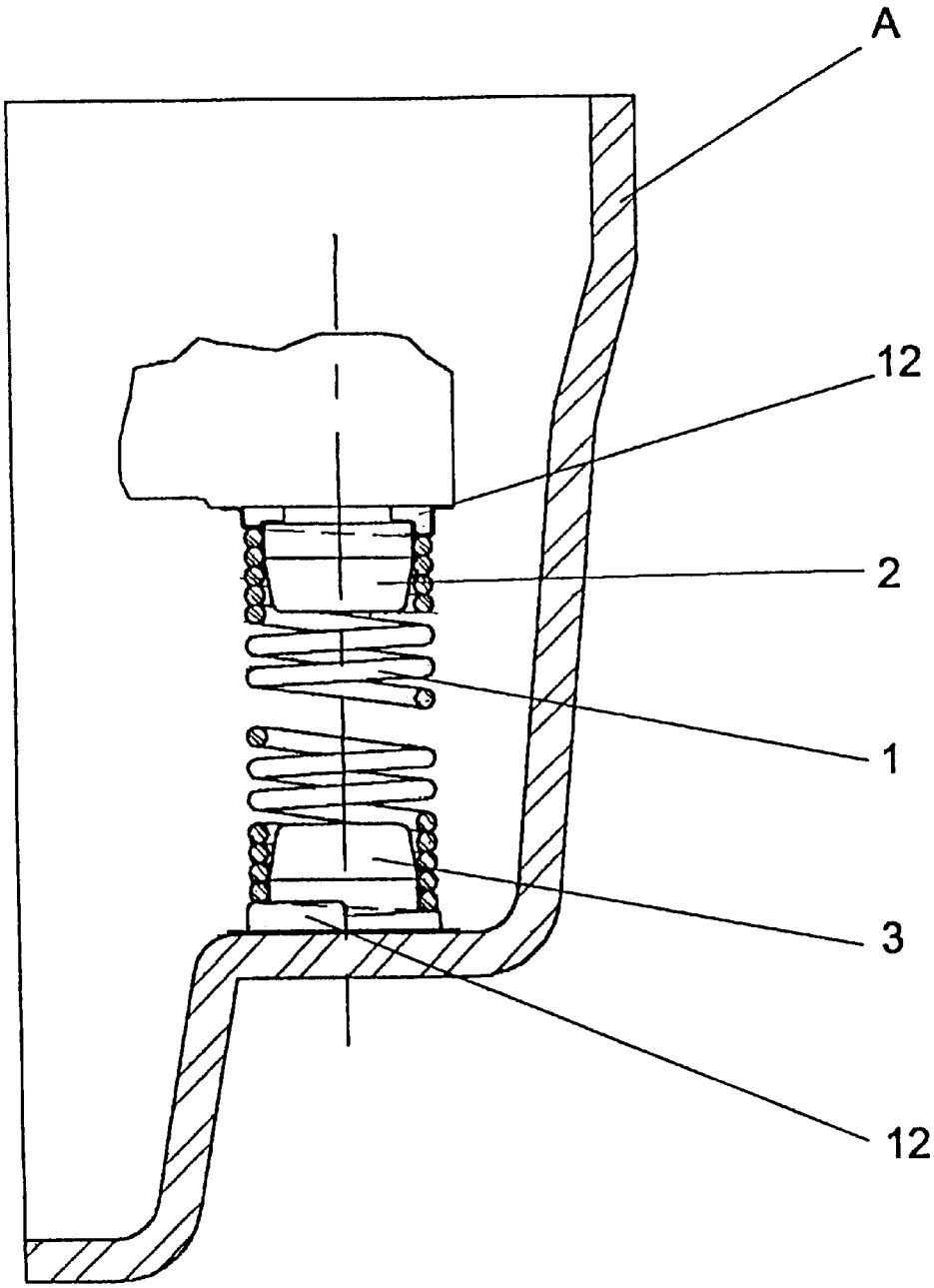
FIG. 8 represents a lateral cut view of the third constructive version mounted.
Figures 9A, 9B, 9C, 9D:
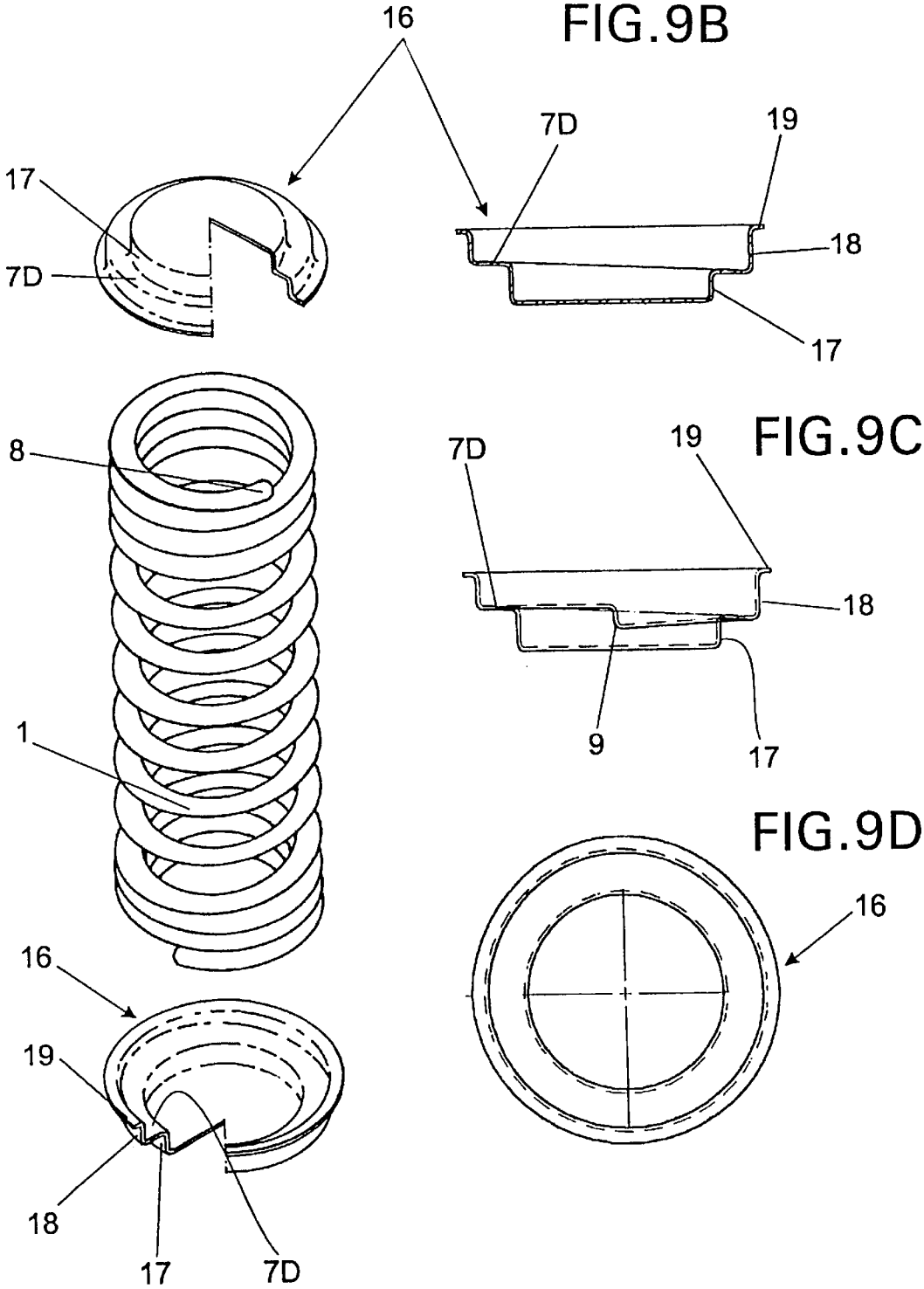
FIG. 9A–9D illustrates a blown up perspective view highlighting the fourth constructive version of the invention—helicoidal seat embossed on metal sheet for spring without grinding.
Figure 10:
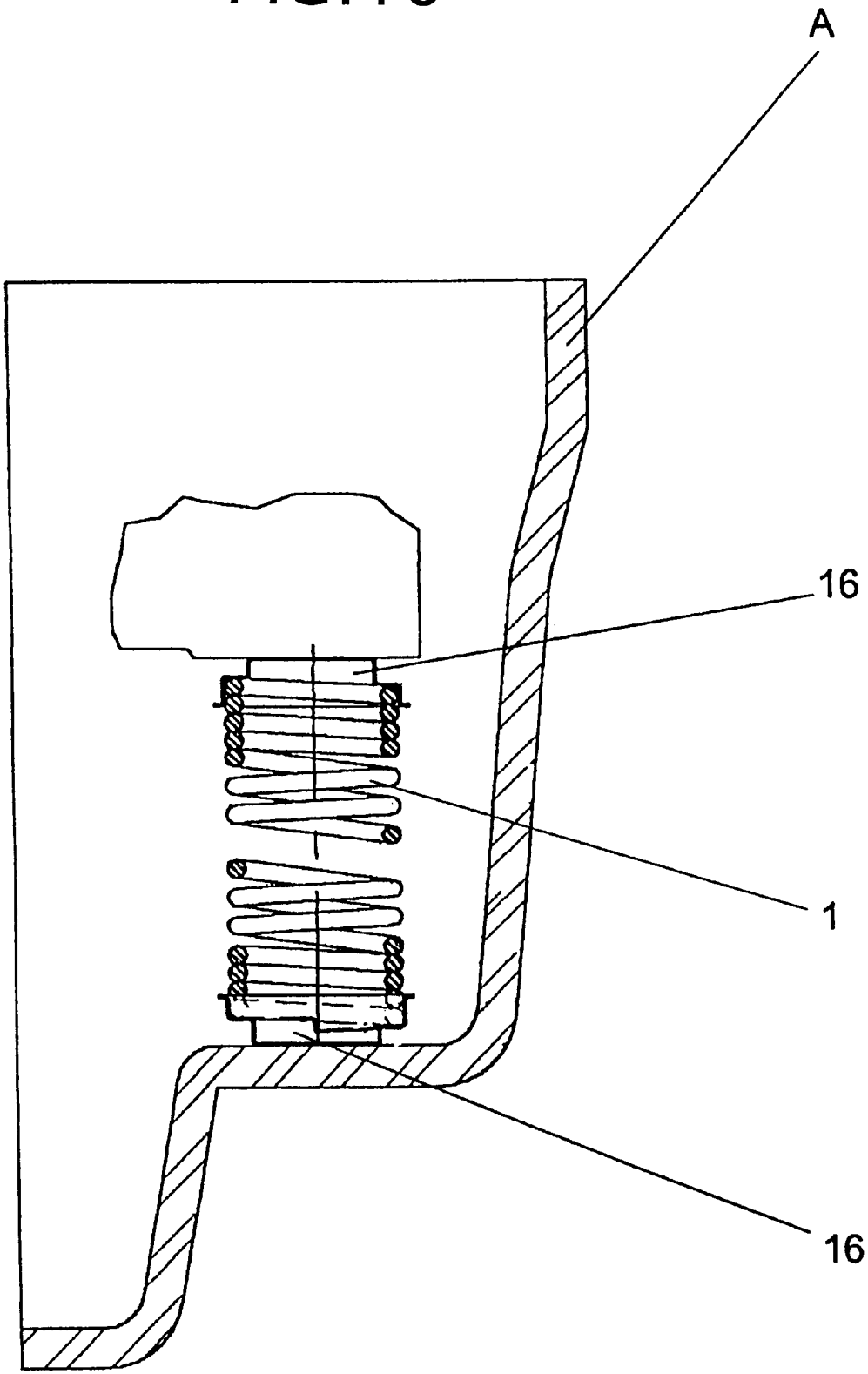
FIG. 10 represents a lateral cut view of the fourth constructive version mounted.

Relating FIGS. 7 and 8, in a third constructive version, the invention is characterized by the fact that the seats with spiral (7C) are formed out of metal sheet parts stamped out in ring shape (12), each one with an inner diameter defined by a circular rim (13) on the same plane to another that defines the external diameter (14) remaining between them the stamped spiral seat (7C), equally projecting and with a step (9), cooperating to the seating of the spring's corresponding extremity (1) inclusively with fittings of its terminals (8) to the steps (9); as also the centering of the spring (1) is done by cylindrical parts (2) and (3) being that in this case, their bases present a circular prolongation (15) that fit into the metal sheet parts' (12) inner diameters (13) and, with that, the extremities of said spring are stably seated against its seats (7C).

In relation to FIGS. 9A–9D and 10, in a fourth constructive variation, the invention is characterized by the fact that each seat in spiral (7D) is formed by an embossed metal sheet (16) like a plate, having a first part of cylindrical bottom with reduced height and completely closed (17) which edge reaches outward defining there the spiraled seat (7D) with the step (9) which edge reaches equally in a cylindrical shape (18) ending in a rim turned outward (19), and as this cylindrical stretch (18) presents inner diameter that conjoins to the fitting of the spring's corresponding extremity (1), in such a way that the extremity can adjust itself against the seat (7D), including the tip (8) of its wire also fit into the step (9), ensuring an ideal fitting that guarantees the said spring's (1) squareness.

Figure 11:
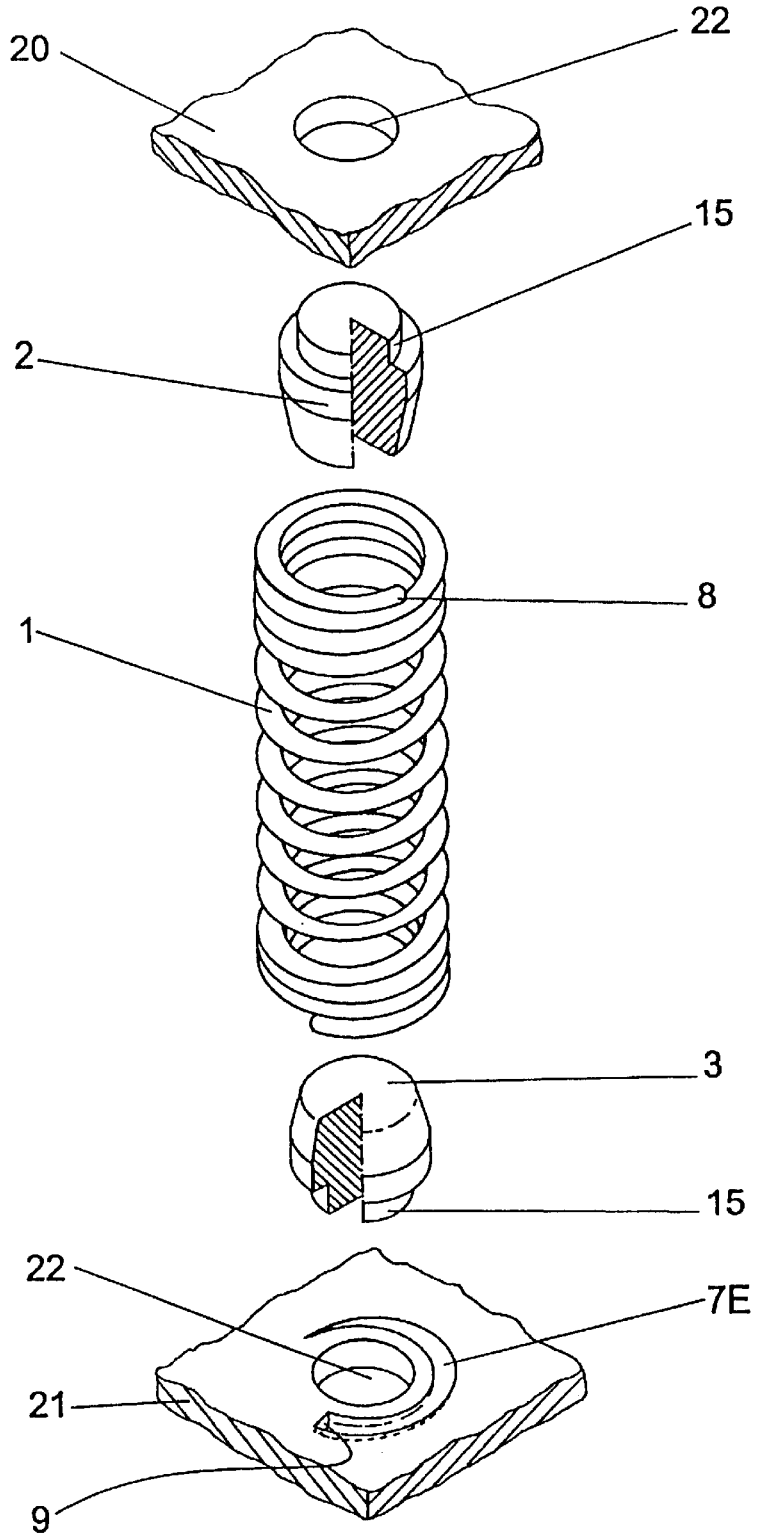
FIG. 11 illustrates a blown up perspective view highlighting the fifth constructive version of the invention—seat pressed against the shell parts for spring without grinding; and, FIG. 12 represents a lateral cut view of the fifth constructive version mounted.
Figure 12:
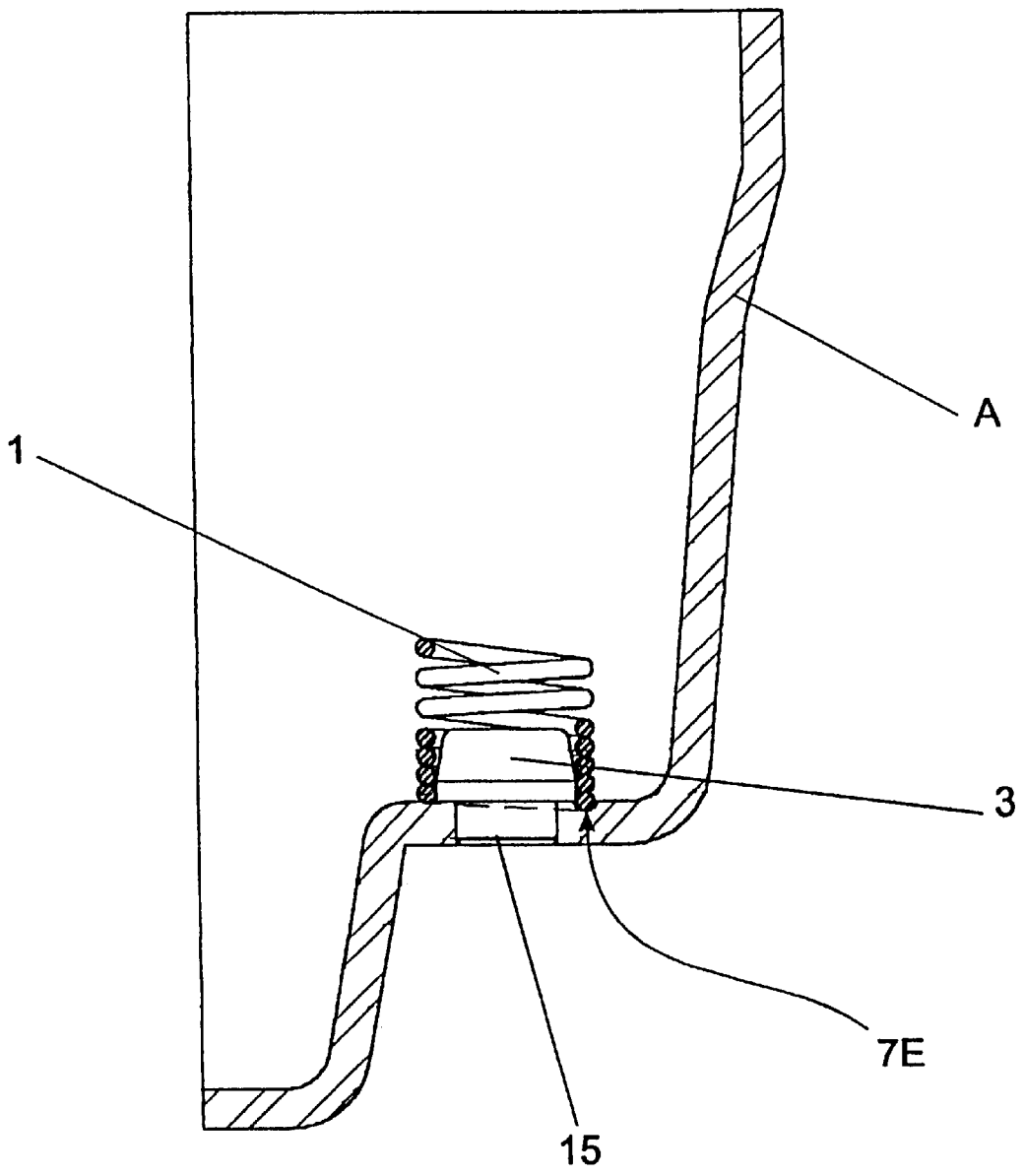

In relation to FIGS. 11 and 12, in a fifth constructive variation, the invention is characterized by the fact that the spiraled seats (7E) are formed by pressed rebating at the corresponding (20–21) parts of the compressor (C) and the shell (A), where each pressing circumscribes a fitting in the shape of a circular opening (22) for penetration of the cylindrical prolonging (15) of the spring's (1) extremities stabilizing part (2 or 3). which in turn, after having been fitted into the pressed parts or pressed spiraled seats (7E) with step (9) remains vertically stable In this constructive version the pressed seat (7E) could be foreseen only on the shell (A), while the opposite side could utilize one of the versions previously described, keeping the same technical effect.

As it is perceived after what was exposed and illustrated, any of the constructive variations adopted for the formation of the seats (7) allows the use of springs (1) without that grinding operation (R) and, consequently are concretized those advantages previously mentioned.

Having thus described the invention, it is claimed:

1. Apparatus for suspending a refrigeration compressor inside a hermetically closed shell with a helicoidal spring disposed between said compressor and said shell, said apparatus comprising:

a first and a second spring supports adapted for mounting onto said compressor and the inside of said shell respectively, each said spring support further including an inclined helicoidal spring seating surface adapted to cooperatively engage an end of said helicoidal spring at least one of said spring supports includes an abutment extending from said helicoidal spring surface and adapted to engage an extremity of said spring.

2. The apparatus of claim 1, wherein said abutment is a step terminating said helicoidal spring seating surface and adapted to engage an extremity of said spring.

3. The apparatus of claim 1, wherein one of said first and second spring supports includes a truncated conical tip circumscribed by and extending beyond said helicoidal spring seating surface to penetrate and cooperatively engage the inner diameter of said helicoidal spring.

4. The apparatus of claim 3, wherein said conical tip is press fit into said one of said first and second spring supports.

5. The apparatus of claim 1, wherein said first and second spring supports are stamped metal, and said helicoidal spring seating surface is formed by stamping.

6. The apparatus of claim 1, wherein one of said first and second spring supports are embossed metal.

7. The apparatus of claim 1, wherein one of said helicoidal spring seating surfaces is formed by press rebating in said compressor.

8. The apparatus of claim 1, wherein one of said helicoidal spring seating surfaces is formed by press rebating in said shell.

* * * * *